US005320470A

United States Patent [19]

Russell

[11] Patent Number: 5,320,470

[45] Date of Patent: Jun. 14, 1994

[54] DEVICE FOR INSTALLATION OF BUILDING MATERIAL

[76] Inventor: Rockford R. Russell, 2039 S. Fairplay St., Aurora, Colo. 80014

[21] Appl. No.: 831,814

[22] Filed: Feb. 6, 1992

[51] Int. Cl.[5] ..... E04F 21/18

[52] U.S. Cl. ..... 414/11; 248/351

[58] Field of Search ..... 414/11; 248/240.4, 351

[56] References Cited

U.S. PATENT DOCUMENTS

| | | | |
|---|---|---|---|
| 1,582,147 | 4/1926 | Stanley | 414/11 |
| 2,371,561 | 3/1945 | Van Patten | 414/11 |
| 2,883,073 | 4/1959 | Morris | 414/11 |
| 3,143,219 | 8/1964 | Aldrich | 414/11 |
| 3,305,219 | 2/1967 | Rhodes | 414/11 |
| 3,467,261 | 9/1969 | Jewell | 414/11 |
| 3,642,150 | 2/1972 | Zizak | 414/11 |
| 3,910,421 | 10/1975 | Panneton | 414/11 |
| 4,449,879 | 5/1984 | Mercer | 414/11 |
| 4,826,390 | 5/1989 | Paxton | 414/11 |
| 5,163,799 | 11/1992 | Lynn | 414/11 |

*Primary Examiner*—Michael S. Huppert
*Assistant Examiner*—Janice Krizek

[57] ABSTRACT

A device for aiding in the installation of flat building materials includes a plurality of cross bars interconnecting first and second angles so that a first offset is formed between the first angle and the cross bars in order to accommodate a building material. A third angle is pivotally attached by a hinge to the second angle so that a second offset which is less than the first offset is formed between the third angle and the cross bars. Fasteners secure the first and third angles to a building framework.

1 Claim, 4 Drawing Sheets

DEVICE FOR INSTALLATION OF BUILDING MATERIAL

FIELD OF INVENTION

Figure 1:
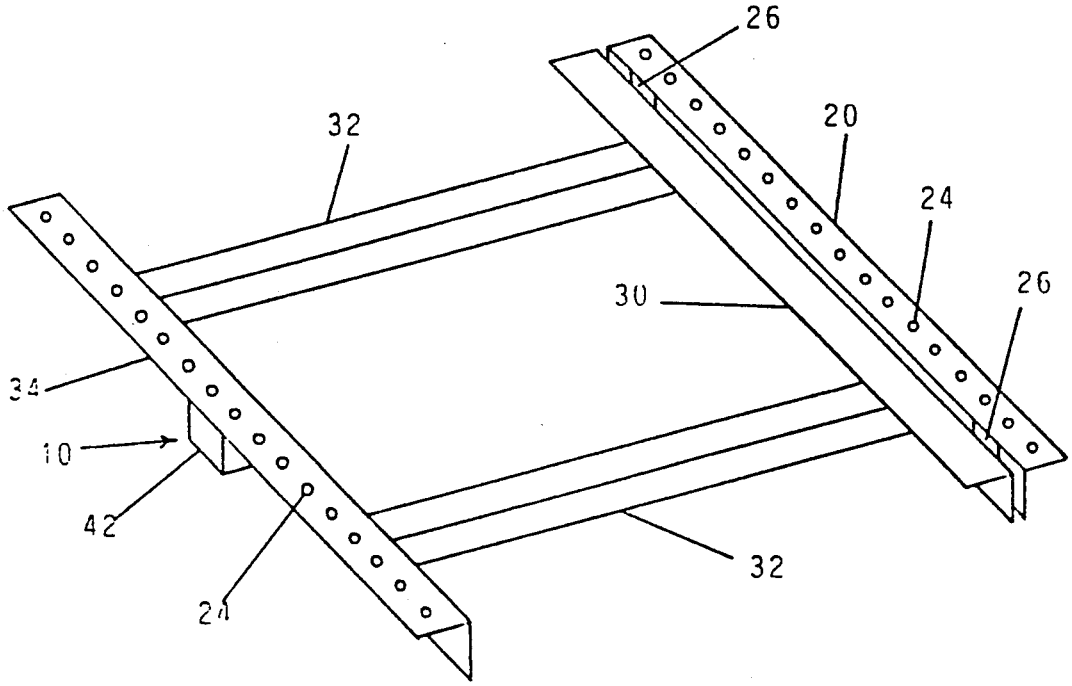

This invention relates to the installation of building materials on walls, overhead, inside or outside.

BACKGROUND

The invention disclosed herein relates to the installing of building materials in sheet form used in the construction of new buildings, or during remodeling of older buildings. The materials used in the construction of buildings are of such size and weight as to be difficult to install. Most require two or more persons to hoist into place while a third person either nails or screws the sheet onto the framing. Over head is very difficult as the sheet must be held and completly anchored into place before the workmen can relax their holds. The hanging of these type of material causes the backs of workers to be strained, and most workmen experience back trouble of one type or another.

Prior art devices that have attempted to solve the above related problems and others include the following U.S. Pat. Nos. 1,582,147 issued to J. C. Stanley; 2,883,073 issued to F. J. Morris; 3,143,219 issued to A. C. Aldrich; 3,305,219 issued to F. Rhodes; 3,467,261 issued to R. C. Jewell; 3,642,150 issued to J. P. Zizak; 3,910,421 issued to J. Panneton; 4,449,879 issued to J. E Mercer; 4,826,390 issued to R. Paxton.

J. C. Stanley teaches a rack device that supports a piece of sheet material placed theron, pivoted into position for anchoring into place. It showes only installing overhead with no provision for vertical use.

F. J. Morris teaches a lifting device for positioning the sheet to the ceiling. In use the device is loaded with a sheet of material, pivoted into position and then propped in place till the sheet is fastened. There is no mention of side wall use.

F. Rhodes teaches a device for positioning the sheet but through the use of a rachet and cables. Again with no mention of vertical use.

A. C. Aldrich teaches a pivotal sheet rack that is supported with a leg or rod for support when in the horizontal position.

R. C. Jewell teaches an easel type device for supporting the sheet of material for ceiling installation. A sheet is placed on the easel frame and then it is rotated into position where it is locked untill the material is attached to the framing.

J. P. Zizak teaches the use of a "T" shaped device that is clamped to the framing on the head of the "T" and the leg of the "T" sets on the floor while the sheet is loaded and then is rotated into place against the ceiling. A leg holds the "T" in place while the sheet material is attached. Again no mention of vertical use.

J. Panneton teaches the use of two "T"s with a frame between for holding the material. One "T" is anchored to the ceiling while the other "T" is in the down position untill the material is hoisted into the up position wedging the sheet into place for attachment. Again no mention of vertical installations.

J. E. Mercer Teaches the use of a rectanglar tower with a rectanglar frame used to support the material and and a folding "T" leg at the other end of the frame. Again no mention of vertical use.

R. Paxton teaches the use of two arms that are clamped to the framing of the building. These arms are rotated to hold the building materials in place for attachment. The use of clamps could not be used to place the last sheet in place, nor could they be used on most metal framing members. The placement of two arms would require two or more person to place, and would require a lot of time to position them properly.

With the cost of building any type of structure going up it is of prime concern to provide a tool that is easy to use, quick to install and remove and provide very good support for the materials being installed. Whether on the wall or on the ceilings, and at any height the tool provides that and more. With the tool it is much safer to install any sheet material. There is less strain on the back for the sheet is hosited into place from one side. Once in place the sheet is held by the tool allowing the person doing the installation to move about freely. Then the sheet material can be adjusted to fit properly with out the danger of falling.

OBJECTS AND ADVANTAGES

Accordingly, several objects and advantages of my invention are:

A. to greatly aid one, or more persons, installing buiding materials, such as drywall, plywood, accoustics, and any large sheet type goods.

B. to provide a stable platform for the building materials to rest on while being hoisted into place.

C. To provide a secure way of support, once the building materials are in place, and still allow for adjustments for a better fit.

D. To provide a greater margin of safty for the installer from the possiblity of the materials accidently falling before they can be installed.

E. To provide for an easier way to hoist the materials into place.

F. To provide for a way to install materials over head where the floor is not clear.

G. To provide a less strenuous way of hoisting materials, and reduce accidents and back pain.

Further objects and advantages are to provide a lightweight tool that is easy to use, quick to learn it's use, simple in construction and reasonabley priced so as to be able to recover the expense of purchase very quickly. One last object is to build a tool that will give very good service life.

DESCRIPTION FIG. 1 TO 4

The tool of the invention is made of light weight metal, aluminum, titanium, thin steel, ect. Light weight materials to keep the weight down, yet give it enough strength to do the job, and a good length of service.

The tool 10 consists of an angle (20) FIG. 1 that has holes (22) spaced the length of one side. The holes (22) are spaced to provide ample places to fasten (nail, screw ect.) into place. Next the angle (20) has one, or more, or a continous hinge (26) to provide the swing for the tool.

The hinge (26) is connected to the angle (30) which functions as a support for the building material (12) to be installed. This angle (30) is of sufficent length to give good support for the length of the building material. There is a small offset (28) (FIG. 4) between the two angles (20) and angle (30). This is to give the material a small amount of free movement when the tool is in the closed position.

The angle (30) (FIG. 1) is connected to a cross bar (32), or two, or more, of such length as to give good support for the width of the building material, plus a small amount of extra width so the building material can be adjusted.

The cross bars (32) are then connected to angle (34) which has holes (24) for anchoring through into the structure of the building in several places. This angle (34) has a large offset (36) (FIG. 3), so as to allow the building material a place to set on one edge when loaded into the tool and a rest 38 for the edge of sheet (12). Also additional offset to allow for final adjustment once the tool is closed and anchored into place. The optional pole (40) (FIG. 2), is used to hold the tool in place until the fastners are installed through the holes (22) in angle (34) (FIG. 1).

The tool can be made of wood, aluminum, titanum, or any other light weight materials. Shapes such as angles, bars, round, square, or whatever could all be used to construct the tool. Most of these metal shapes are availible at most suppliers, lumber yards, and hardware stores.

Figure 2:
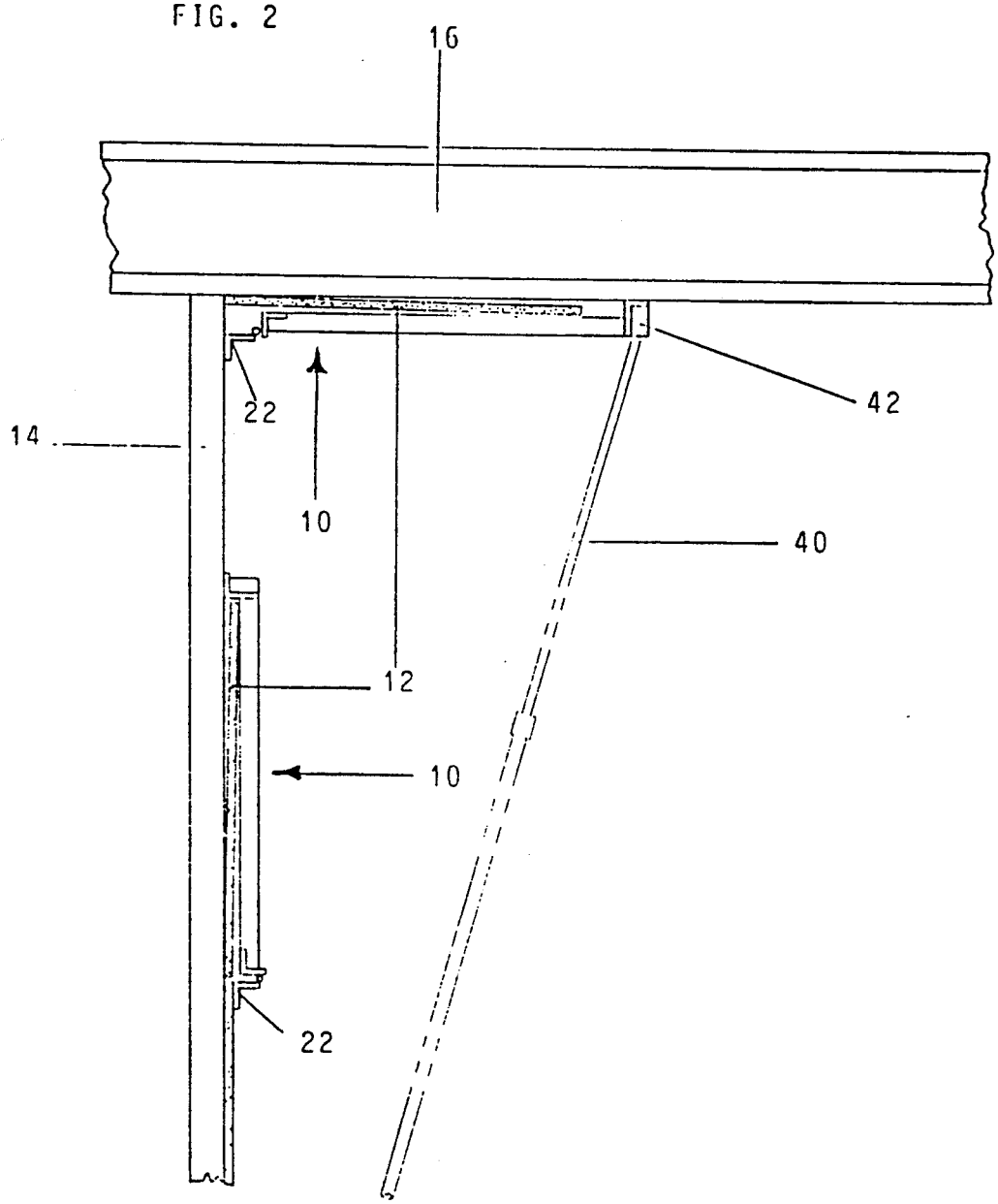
Figure 3:
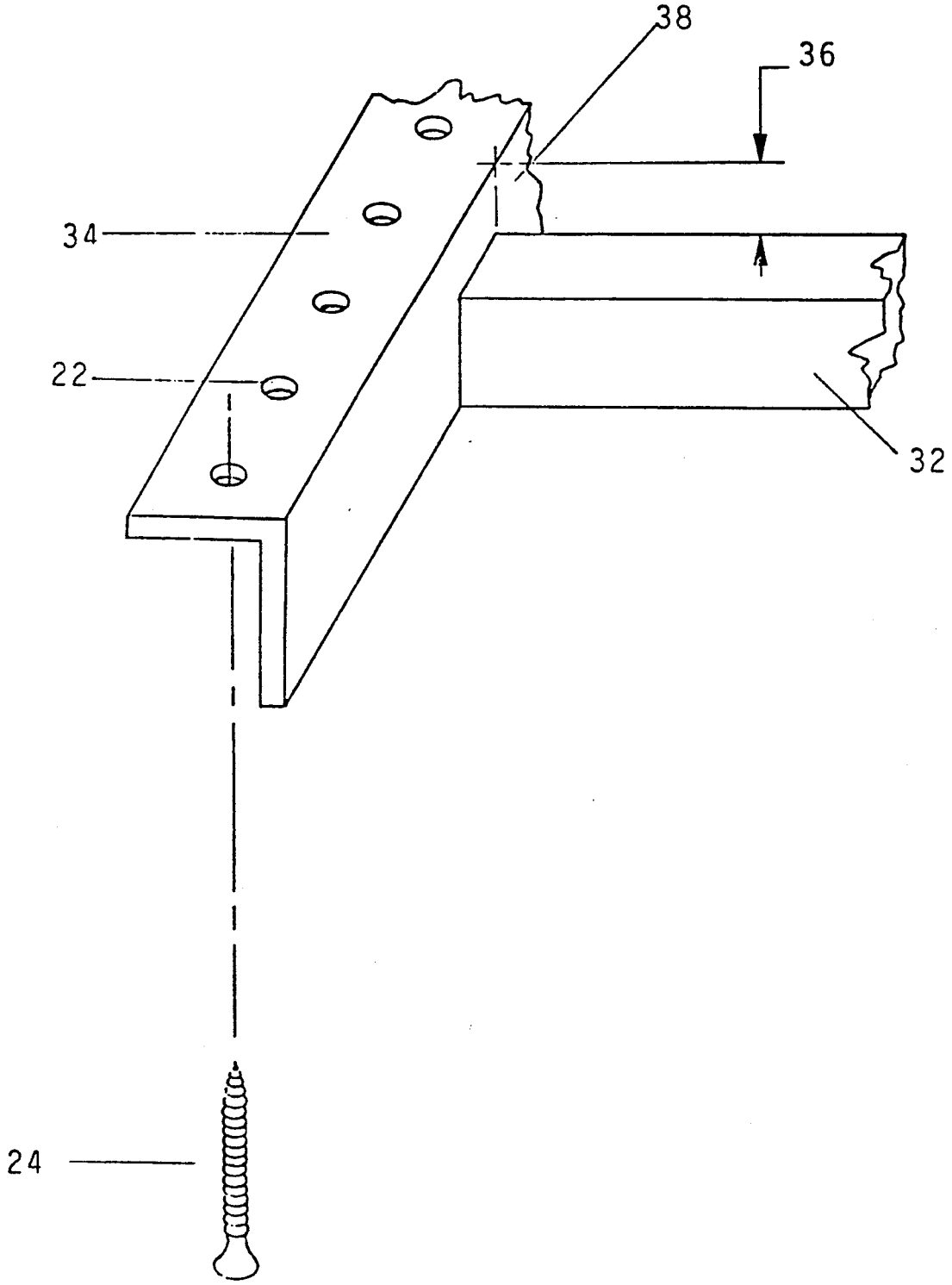
Figure 4:
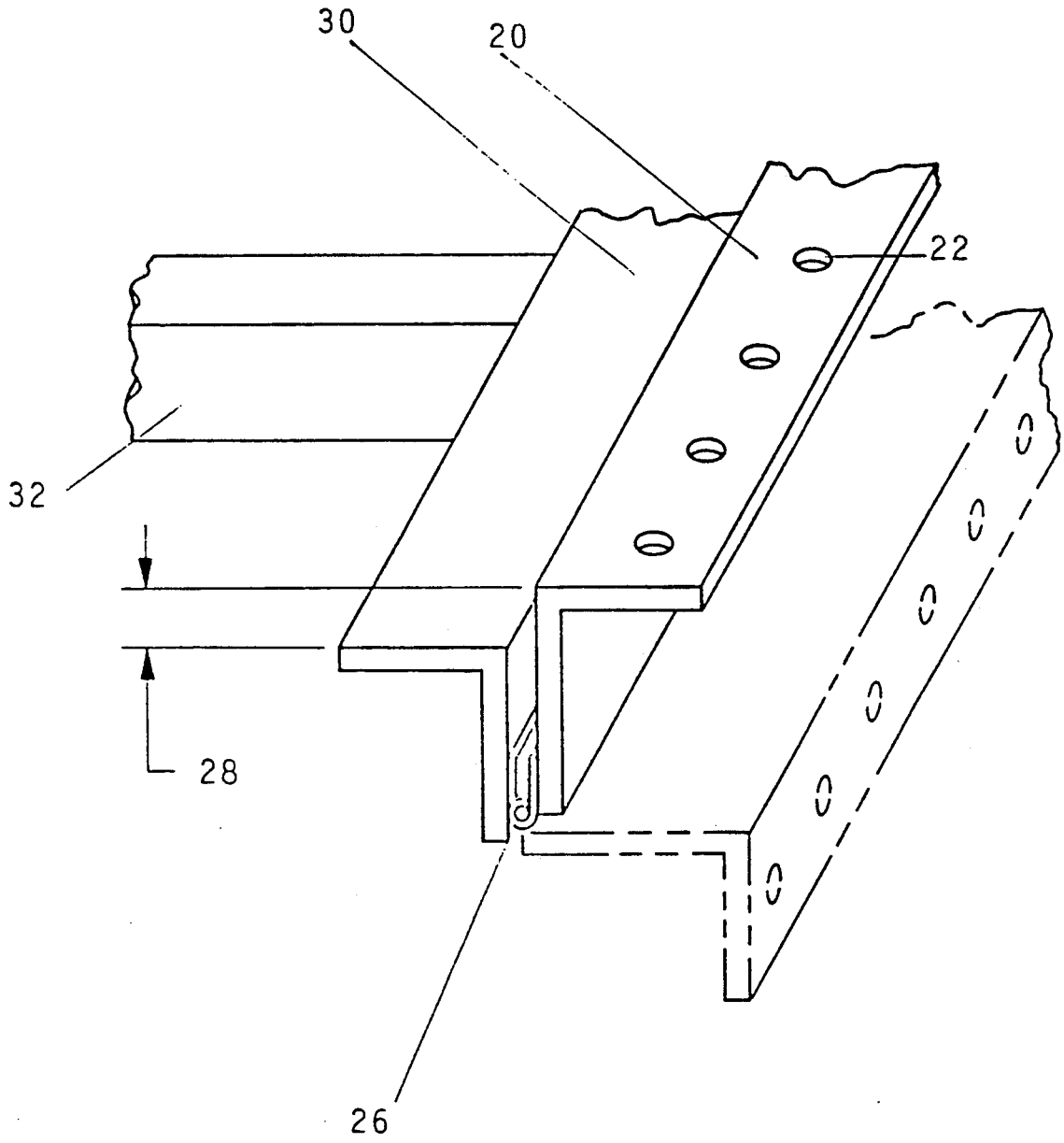

REFERENCE NUMERALS IN DRAWINGS:

FIG. 1 Shows the tool in isometric prospective
FIG. 2 Shows the tool in an end view
FIG. 3 Shows the large offset
FIG. 4 Shows the small offset

PART NUMBER AND NAME AND DISCRIPTION 20 angle—hinged with holes for anchors
34 angle—with holes for anchors
30 angle—hinged
32 cross bar
26 hinge
36 large offset
28 small offset
22 anchor holes
40 optional pole NOTE: All pieces are either welded, screwed, riveted, or bolted together, not shown for simplicity.

OPERATION:

To place one sheet above the first installed on the wall adjacent to the floor.

A. Rotate the angle (20) on the wall even with the top edge of the first sheet. Anchor the angle (20) into place through the holes (22) in angle (20).
B. Load the next sheet face down into the tool. Align the ends of the sheet, and rotate the tool into the closed position. Anchor angle (34) using screws (24) through the holes (22) in angle (34) to the framing members (14, 16) of the building.
C. Make final adjustments of the sheet and fasten into place.
D. Remove tool from wall. install any fastners missed in sheet.
E. Begin again with another setup and the next sheet.

To start ceiling next to a wall.

A. Rotate angle (20), for wall installation. Measure from angle (20) to angle (30) to obtain X. Now add thickness of material to be placed on ceiling.
B. Measure down from ceiling joist (16) X+material thickness, add an extra ⅛ inch or so, for free movement of building materials, and draw a horizonal line.
C. Place angle (20) below line and anchor into place through the holes (22) in angle (20).
D. Place material for the ceiling into the tool and hoist into place. The optional pole (40) can be used to hold the tool till screws (24) are placed through the holes (22) in angle (34).
E. Align building material and anchor into place.
F. Remove tool from ceiling. Install any anchors missed in the sheet.
G. Begin again with a new setup and the next sheet.

Butting one sheet next to another.

A. Install angle (20) on edge of sheet already anchored to the ceiling.
B. Load the next sheet of building material into the tool. Now swing the tool to the closed position. The optional pole (40) can be used to help hold the tool in place until the angle (34) is fastened.
C. Align sheet and fasten into place.
D. Remove the tool from the ceiling. Install any fasteners missed in the sheet of building material.
E. Begin again on a new setup and the next sheet.

Installing exterior siding materials.

A. Rotate angle (20) on the wall even with the top of the first sheet. Anchor the angle (20) into place.
B. Load the next sheet face down into the tool. Align the ends of the sheet, and rotate tool into place. Anchor angle (34) to the framing members of the building.
C. Make final adjustments of sheet and fasten in place.
D. Remove tool from wall. Install any fastners missed.
E. Begain again with another setup and the next sheet.

ADVANTAGES

A. The tool allows one person to install building materials, whereas previously it took two or more.
B. The tool holds the materials in a very close proximty of the final location for installation, but allows for adjustment of the building materials.
C. Once the tool is closed and anchored properly, the person doing the work is free to move about with very little danger of the material falling.
D. Hoisting the material is less strenuous on the back.

SUMMARY

The tool is constructed of light weight materials that are easily obtained from local sources. It is either bolted, welded, screwed, or by using any other type of fastner, secured together. The tool can also be built in a knock down and quick assembly form. The width and length are of sufficent dimensions as to give very good support to the building materials being installed. The shape of the metals used in the construction of the tool, can be varied, but should be of adequate strength as to give very good service life to the tool.

The holes (22) FIG. 1, in angle (20) and angle (34) should be of such spacing that would allow for being able to anchor to any spacing of studs in walls, or any ceiling joists.

The tool will give one person the advantage of being able to install most building materials with a degree of greater ease. Once the tool is closed and anchored into place, the installer is free to move about with a great deal of the danger removed of falling materials. In addition, the tool can be used at any height above the floor, as well as over an object that can not be moved.

CONCLUSION AND SCOPE OF INVENTION

Thus the reader can see that the tool provides a much easier and safer way to install some building materials by one or more persons. It is lightweight and portable. In addition it is easy to use.

While my above description contains many specifications these should not be construed as limitations on the scope of the invention, but rather as an exemplification of one perferred embodiment thereof. Many more variations are possible. For example the type of materials used to construct the tool. A rest between bars (32) next to angle (34) for length support for the building materials. Another is the need for a way to hold the Optional pole (40) in place so it will not slip and fall. A hole, clip, bracket (42) could be used for the pole to fit into. The length and width of the tool could be varied for the size of the materials to be installed. A knock down model would greatly reduce the bulk of the tool.

I claim:

1. A sheet material lifting and supporting device comprising:

a first angle having a planar surface and a plurality of holes;

a second angle;

a plurality of cross bars, each of the plurality of cross bars having one end, another end and a first planar surface, one end of the cross bars being attached to the first angle so that the planar surface of the first angle is substantially parallel to the planar surface of the plurality of cross bars and so that a first offset is formed between the planar surface of the first angle and the planar surfaces of the cross bars in order to accommodate the sheet material, the other end of the cross bars being attached to the second angle;

a third angle having a planar surface and a plurality of holes;

hinge means pivotally connecting the third angle to the second angle so that a second offset is formed between the planar surface of the third angle and the planar surfaces of the plurality of cross bars, the second offset being less than the first offset; and fastening means for extending through the holes of the first and third angles in order to attach the first and third angles to a building framework.

* * * * *